US009976222B2

(12) United States Patent
Nieminen et al.

(10) Patent No.: US 9,976,222 B2
(45) Date of Patent: May 22, 2018

(54) BUBBLE COLLECTOR GUIDE AND USE THEREOF

(71) Applicant: Outotec (Finland) Oy, Espoo (FI)

(72) Inventors: Ville Nieminen, Pori (FI); Henri K. Virtanen, Pori (FI); Heikki Aaltonen, Nakkila (FI)

(73) Assignee: Outotec (Finland) Oy, Espoo (FI)

( * ) Notice: Subject to any disclaimer, the term of this patent is extended or adjusted under 35 U.S.C. 154(b) by 274 days.

(21) Appl. No.: 14/403,653

(22) PCT Filed: Jun. 6, 2013

(86) PCT No.: PCT/FI2013/050617

§ 371 (c)(1),
(2) Date: Nov. 25, 2014

(87) PCT Pub. No.: WO2013/182755

PCT Pub. Date: Dec. 12, 2013

(65) Prior Publication Data

US 2015/0176145 A1 Jun. 25, 2015

(30) Foreign Application Priority Data

Jun. 7, 2012 (FI) ..... 20125622

(51) Int. Cl.

| | |
|---|---|
| ***C25C 1/00*** | (2006.01) |
| ***C25C 3/08*** | (2006.01) |
| ***C25C 7/02*** | (2006.01) |
| ***C25C 1/12*** | (2006.01) |
| ***C25C 7/00*** | (2006.01) |

(52) U.S. Cl.
CPC ..... *C25C 7/02* (2013.01); *C25C 1/12* (2013.01); *C25C 7/00* (2013.01)

(58) Field of Classification Search
CPC .... C25C 1/00; C25C 7/02; C25C 7/00; C25C 3/08
USPC ..... 205/560
See application file for complete search history.

(56) References Cited

U.S. PATENT DOCUMENTS

| | | | |
|---|---|---|---|
| 547,045 | A | 10/1895 | Sturtevant et al. |
| 3,930,151 | A | 12/1975 | Shibata et al. |
| 4,668,353 | A | 5/1987 | Smith et al. |
| 5,470,445 | A | 11/1995 | Murray et al. |

(Continued)

FOREIGN PATENT DOCUMENTS

| | | |
|---|---|---|
| CA | 1258043 | 8/1989 |
| CN | 101220490 A | 7/2008 |
| GB | 1460357 | 1/1977 |

OTHER PUBLICATIONS

Finnish Search Report from related Finnish Application No. 20125622, dated Mar. 22, 2013, 1 pg.

(Continued)

*Primary Examiner* — Zulmariam Mendez
(74) *Attorney, Agent, or Firm* — Chernoff, Vilhauer, McClung & Stenzel, LLP

(57) ABSTRACT

The invention concerns a bubble collector guide for use in an electrolysis process, which comprises a plurality of guide members arranged at a distance from each other, the guide members comprising a lower side. The guide members can be arranged horizontally on the vertical surface of an electrode so that the lower side of the guide member forms a downwards facing surface that is substantially orthogonal to the vertical surface of the electrode, so as to collect bubbles of gas generated at the electrode.

18 Claims, 6 Drawing Sheets

(56) References Cited

U.S. PATENT DOCUMENTS

| | | | |
|---|---|---|---|
| 5,538,608 | A | 7/1996 | Furuya |
| 2010/0307913 | A1 | 12/2010 | Ma et al. |

OTHER PUBLICATIONS

International Search Report from related PCT application No. PCT/FI2013/050617, search report dated Aug. 13, 2013, 3 pgs.

BUBBLE COLLECTOR GUIDE AND USE THEREOF

FIELD OF THE INVENTION

The invention relates to a bubble collector guide for use in an electrolysis process and use thereof.

BACKGROUND OF THE INVENTION

Electrolysis processes, for instance sulfate-based electrowinning of metals such as copper, typically take place in an electrolytic cell that contains a number of anodes and a number of cathodes arranged in an alternating manner. In the sulfate-based electrowinning process, an anode made of lead alloy or an anode with an electrocatalytically active coating and a cathode made of stainless steel are immersed in an electrolyte bath containing a solution comprising e.g. copper sulfate and sulfuric acid. An electrical current from the anode to the cathode induces an electro-chemical reaction, wherein copper is deposited on the surface of the cathode. At the same time, oxygen gas is generated on the anode. The oxygen generated forms very small bubbles on the anode surface. These bubbles subsequently rise to the surface of the electrolyte containing sulfuric acid, burst and release a fine aerosol or mist of electrolyte into the atmosphere above the electrolyte. This aerosol or mist, referred to as acid mist, typically has a similar composition as the electrolyte, i.e. contains sulphuric acid and metal salts, and has a number of harmful side effects: it is harmful to personnel working in the tankhouse and causes corrosion when deposited on surfaces in the tankhouse. The acid mist is typically composed of liquid particles or droplets of approx. 1-100 μm in diameter in suspension.

Several techniques are available for reducing acid mist in tankhouses. These include chemicals such as surfactants (e.g. FC-1100), mechanical barriers such as layers of spheres, beads and the like, improved ventilation (e.g. cross-flow) and hoods and cell covers above the cells to remove acid mist. One example of a tank cover apparatus for reducing acid mist is described in U.S. Pat. No. 5,470,445. U.S. Pat. No. 4,668,353 describes clips and masking devices that restrict the electrolyte surface area through which bubbles can pass into the atmosphere.

These techniques however have drawbacks and may be impractical to use. Hoods and cell covers are effective in removing acid mist, but they do not collect acid mist if not in place, for instance at the time cathodes are being harvested. Hoods and the scrubbing systems associated consume water and energy. Chemicals are an additional expense and they do not provide 100% reduction for acid mist. Further, it would be desirable to be able to reduce the amount of acid mist to a minimum.

PURPOSE OF THE INVENTION

The purpose of the invention is to provide simple, practical means for reducing acid mist in an electrolysis process. The present invention is based on the phenomenon of gas bubble coalescence and the observation that less acid mist is formed when bursting gas bubbles are larger than those evolved on the anode surface.

SUMMARY

The invention discloses a bubble collector guide for use in an electrolysis process, which comprises a plurality of guide members arranged at a distance from each other, the guide members comprising a lower side; wherein the guide members can be arranged horizontally on the vertical surface of an electrode so that the lower side of the guide member forms a downwards facing surface that is substantially orthogonal to the vertical surface of the electrode, so as to collect bubbles of gas generated at the electrode.

When bubbles are collected under said downwards facing surface that is substantially orthogonal to the vertical surface of the electrode, they coalesce together to form larger bubbles. When the bubbles have reached a certain diameter, they will escape from said downwards facing surface of the guide member due to their buoyancy, reach the electrolyte surface level and burst. The depth of the guide member and/or its lower side can be selected suitably to allow the bubbles to coalesce to a certain diameter.

In different embodiments of the invention, the number of the guide members arranged to the vertical side of an electrode can be suitably selected e.g. on the basis of the used current density or the bubble volume formed per area of electrode.

In an embodiment of the invention, the guide member substantially extends the full width of the vertical surface of the electrode.

In an embodiment of the invention, the guide member is immersed in the electrolyte.

In one embodiment of the invention, the guide member is sealably attachable to the vertical surface of the electrode.

In such an embodiment, the guide member can be sealably attached to the vertical surface of the electrode using suitable means, for instance an adhesive such as molten polymer or glue or e.g. non-conducting screws, nails, staples, bolts or abutments, or a combination thereof. This embodiment has the added utility that it prevents small bubbles from escaping through between the vertical surface of the electrode and the guide member.

In embodiments of the invention, the guide members can be arranged at a suitable distance from each other.

In an embodiment of the invention, the guide members are arranged at an equal distance from each other.

In an embodiment of the invention, the guide members are arranged at varying distances from each other. For instance, the distances between guide members arranged toward the upper part of the vertical surface of the electrode can be shorter than the distances between guide members arranged toward the lower part of the vertical surface of the electrode.

In one embodiment of the invention, the guide members can be arranged along the length of the vertical surface of the electrode. In other words, the guide members can be arranged on the whole area of the vertical surface of the electrode.

In one embodiment of the invention, the guide members are of the same size and depth.

In one embodiment of the invention comprising a plurality of the guide members, the guide members are of different sizes and/or depths.

In one embodiment of the invention, the guide member and/or the downwards facing surface formed by the lower side of said guide member has a linear shape or profile. In such an embodiment, the lower side of the guide member forms a planar downwards facing surface that is substantially orthogonal to the vertical surface of the electrode.

In other embodiments, the guide member and/or the downwards facing surface formed by the lower side of said guide member can have any other suitable shape or profile. In one embodiment of the invention, the guide member and/or the downwards facing surface formed by the lower side of said guide member has a saw-edged shape or profile. In one embodiment of the invention, the guide member and/or the downwards facing surface formed by the lower side of said guide member has an undulating shape or profile. In one embodiment of the invention, the guide member and/or the downwards facing surface formed by the lower side of said guide member has a cogged shape or profile.

In one embodiment of the invention, the guide member comprises orifices or apertures.

In one embodiment of the invention, the bubble collector guide comprises at least one support member. In another embodiment of the invention, the support member connects the ends of guide members. In one embodiment of the invention, the support member(s) can be arranged on the vertical surfaces of the electrode.

These embodiments allow easy installation of the bubble guide collector, since it can easily be slid on the electrode.

In one embodiment of the invention, the bubble collector guide is made in one piece.

In one embodiment of the invention, the bubble collector guide is made from a suitable polymer. The bubble collector guide can, however, be made from any suitable material. Preferably, the material is non-conducting.

In one embodiment of the invention, the support member(s) extend farther away from the vertical side of the electrode than the guide member(s) so as to prevent other parts of the electrolysis system, such as other electrodes, from touching the guide members. When an electrolyte cell is loaded with electrodes, for instance cathodes in an electrowinning process, it is important that the edges of the electrode will not destroy the guide members. The support member(s) can thus function as electrode (e.g. cathode) guides.

In an embodiment of the invention, the bubble collector guide comprises one or more spacers for keeping electrodes at correct distances from each other.

The invention also relates to the use of the bubble collector guide according to the invention in an electrolysis process together with other means for reducing acid mist. The bubble collector guide can be used together with said other means so as to reduce acid mist generation to a minimum.

In one embodiment of the invention, the other means for reducing acid mist comprise an acid mist suppressant chemical, a diaphragm bag or a hood, or combinations thereof. Several acid mist suppressant chemicals are known to a person skilled in the art, for instance surfactants such as FC-1100.

The invention provides a number of benefits. The bubble collector guide is simple and thus easy and cheap to manufacture. It is also easy to install and maintain, and can be installed on new or existing electrodes even on the site of use, thus providing low installation costs. The invention also requires virtually no or very little maintenance, thus providing low maintenance costs. The invention requires no additional power source, and since less acid mist is produced, less ventilation and consequently less energy is required—thus the invention can significantly lower the total energy consumption of the electrolysis system. In systems in which hoods to capture acid mist are used, scrubbing capacity and water consumption associated are also reduced.

While particularly useful in electrowinning processes, the invention may be utilized in any gas evolving electrolysis process to reduce electrolyte aerosol production.

The embodiments of the invention described hereinbefore may be used in any combination with each other. Several of the embodiments may be combined together to form a further embodiment of the invention. A product or a use, to which the invention is related, may comprise at least one of the embodiments of the invention described hereinbefore.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION OF THE INVENTION

Reference will now be made in detail to the embodiments of the present invention, examples of which are illustrated in the accompanying drawings.

For reasons of simplicity, item numbers will be maintained in the following exemplary embodiments in the case of repeating components.

Figure 1:
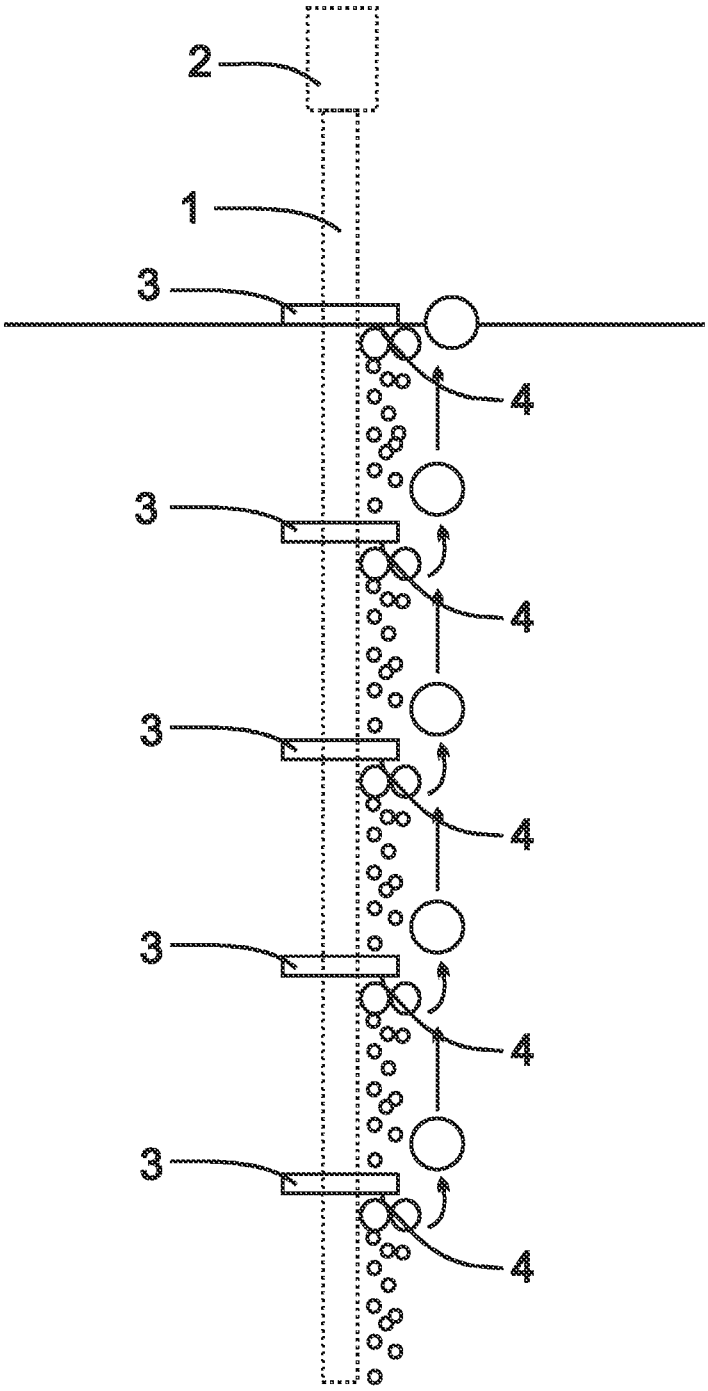
FIG. 1 is a side view of a bubble collector guide comprising a plurality of guide members arranged on the vertical side of the electrode.

FIG. 1 shows a side view of a bubble collector guide according to the invention. An electrode 1 is shown in dotted line. The electrode is attached to an electrode hanger bar 2 (also in dotted line). The bubble collector guide comprises a plurality of guide members 3 which are arranged on the vertical side of the electrode 1. Bubbles of gas (shown as circles) generated at the electrode are collected below the lower side 4 of the guide members 3. The arrows demonstrate how coalesced bubbles move from underneath the lower side of the guide members to the electrolyte and to the electrolyte surface.

Figure 2:
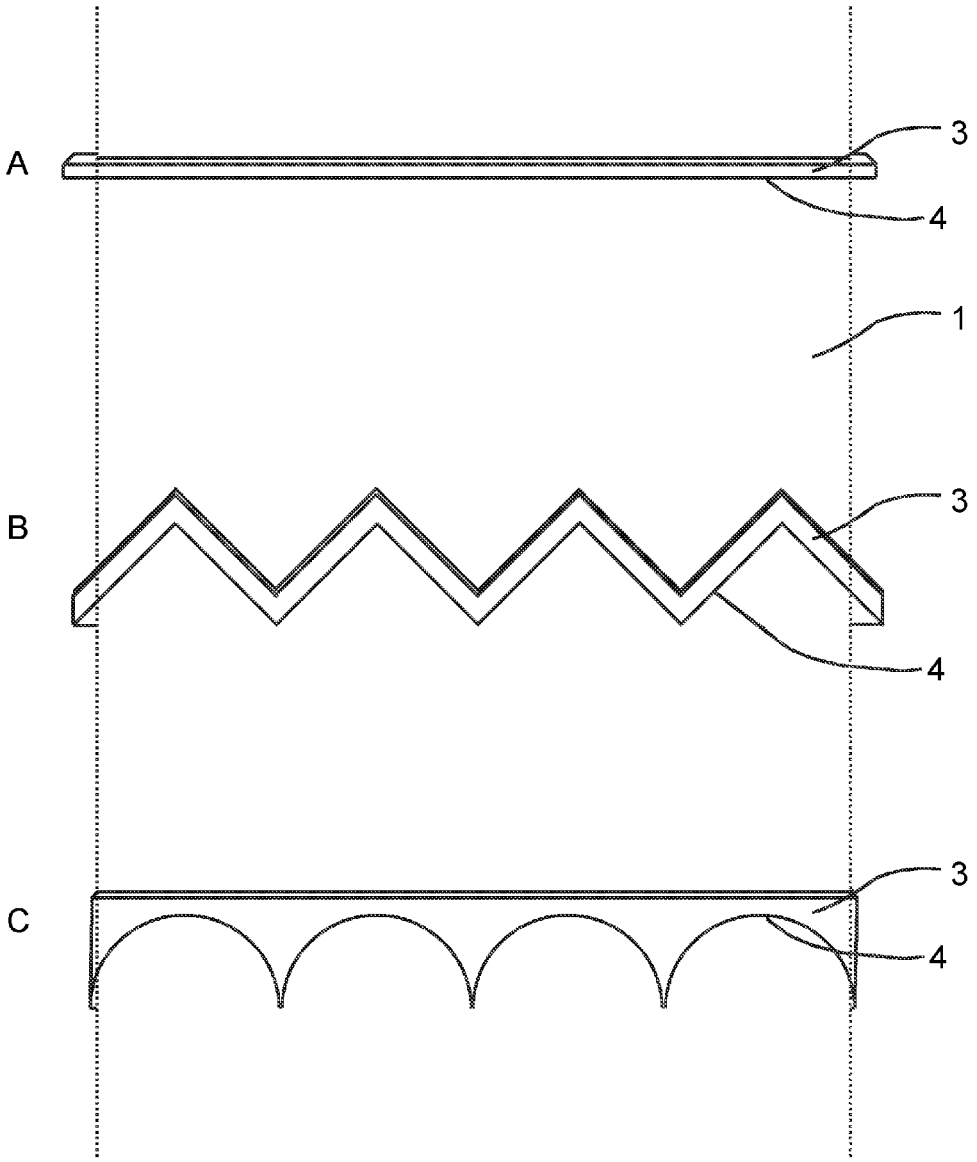
FIG. 2 shows examples of possible shapes or profiles of the downwards facing surface formed by the lower side of the guide member.

FIG. 2 shows examples of possible shapes or profiles of the guide members of the invention and/or the downwards facing surface formed by the lower side of said guide members. FIG. 2A shows a guide member 3 and its lower side 4 which have a linear shape; 2B shows a guide member 3 and its lower side 4 which have a saw-edged shape; and 2C shows a guide member 3 the lower side 4 of which forms a downwards facing surface that has a cogged shape.

Figure 3:
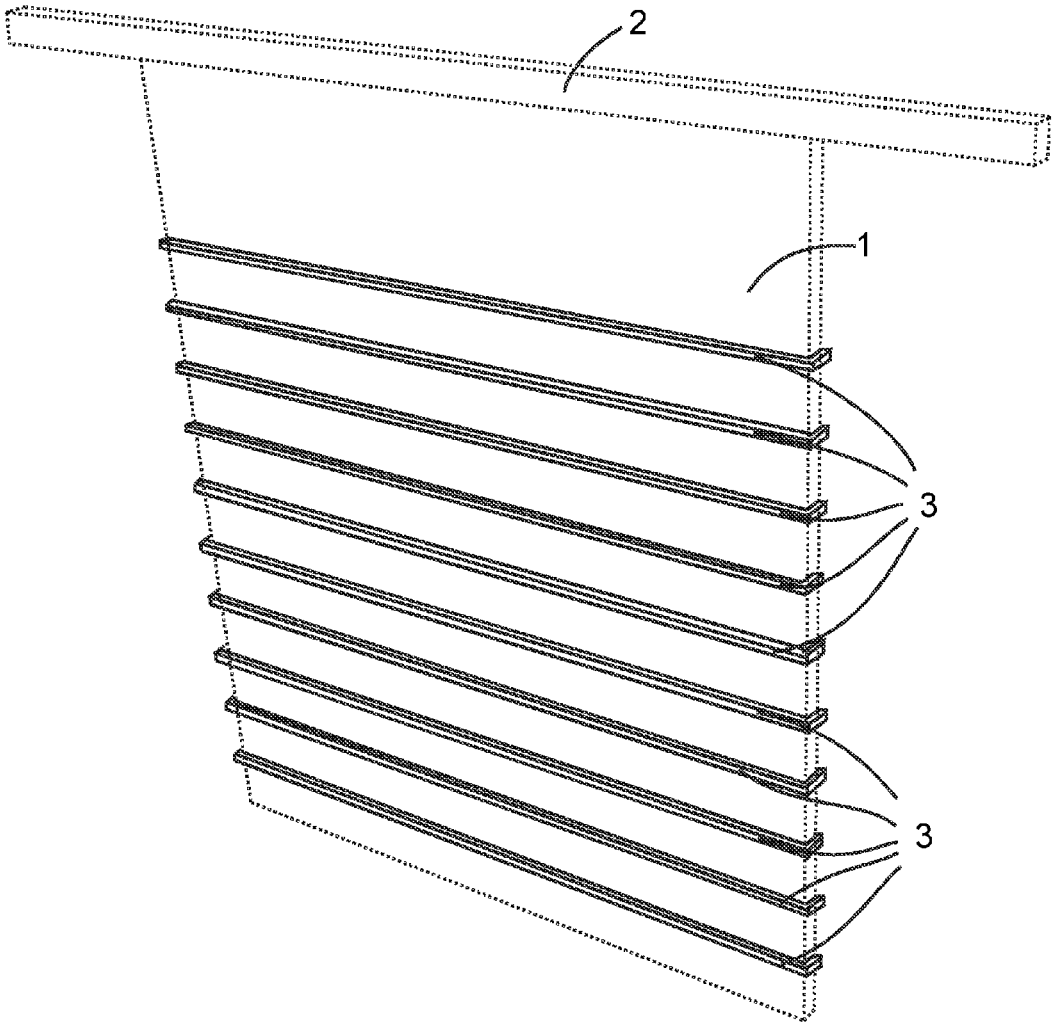
FIG. 3 shows a bubble collector guide comprising a plurality of guide members arranged on the vertical side of an electrode, FIG. 4 demonstrates an embodiment of the bubble collector guide comprising a plurality of guide members and support members.

FIG. 3 shows another view of a bubble collector guide comprising a plurality of guide members 3 arranged on the vertical side of the electrode 1. The electrode 1 is attached to an electrode hanger bar 2 (in dotted line). The bubble collector guide up to the uppermost guide member may be sunk below the electrolyte surface.

Figure 4:
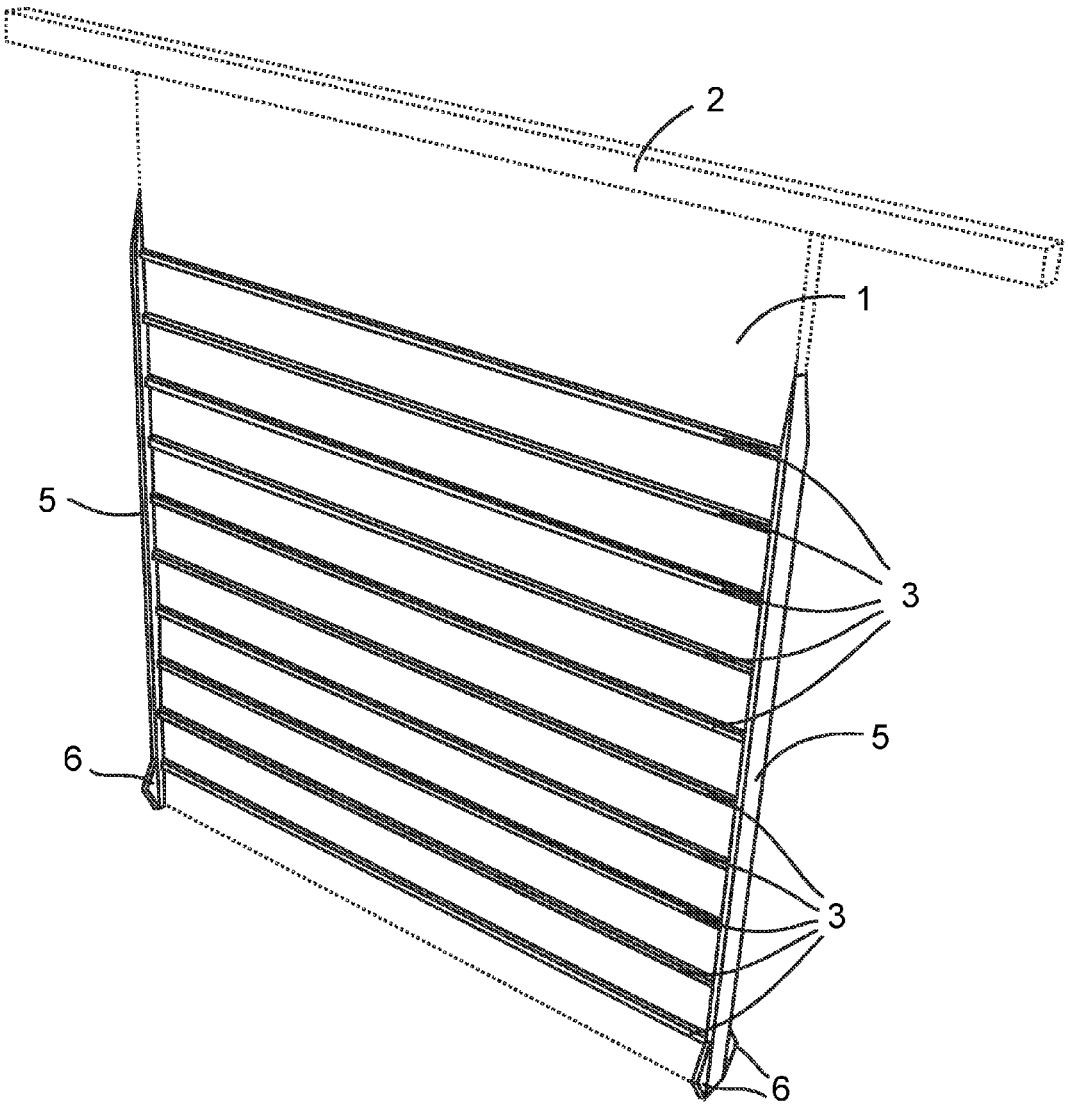

FIG. 4 demonstrates an embodiment of the bubble collector guide arranged on an electrode 1 attached to an electrode hanger bar 2. The electrode has a rectangular shape and comprises two broad and two narrow vertical surfaces. The bubble collector guide comprises a plurality of guide members 3 arranged on the vertical surface of the electrode 1 and support members 5 which connect the ends of the guide members on the two sides of the electrode. The support members 5 are arranged on the two narrow vertical surfaces of the electrode. In the embodiment shown in this figure, the support members 5 extend farther away from the broad vertical surface of the electrode than the guide members so as to prevent other parts of the electrolysis system, such as cathodes loaded into the system, from touching the guide members. The embodiment shown in this figure comprises several spacers 6 that keep other electrodes and other parts of the electrolysis system apart from the guide members and the electrode. The spacers 6 are attached to the support members.

Figure 5:
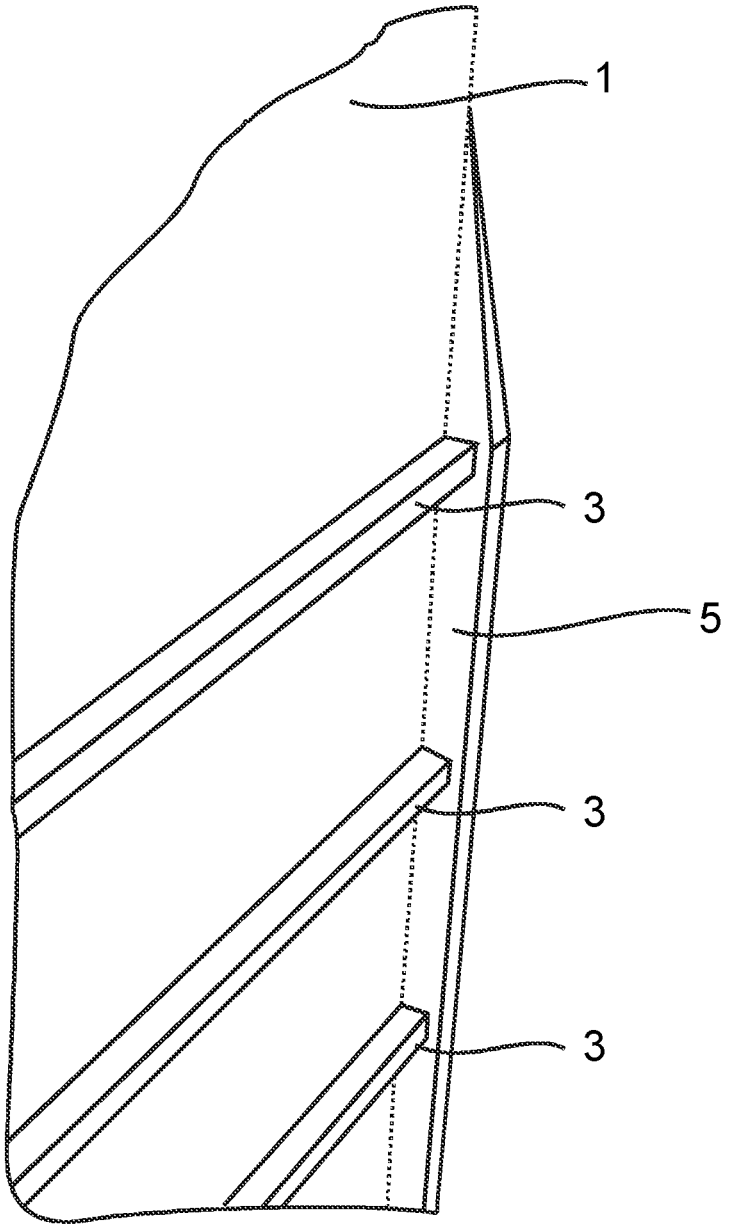
FIG. 5 is a close-up of the bubble collector guide shown in FIG. 4.

FIG. 5 is a close-up of the bubble collector guide shown in FIG. 4 from a different angle. This close-up clearly demonstrates how the support members 5 extend farther away from the broad vertical surface of the electrode than the guide members 3 so as to prevent other parts of the electrolysis system, such as cathodes loaded into the system, from touching the guide members 3. The upper ends of the support members 5 taper towards the upper part of the electrode 1.

It is obvious to a person skilled in the art that with the advancement of technology, the basic idea of the invention may be implemented in various ways. The invention and its embodiments are thus not limited to the examples described above; instead they may vary within the scope of the claims.

Example 1

Bench scale copper electrowinning experiments were carried out to demonstrate the effect of the invention.

A transparent cell with ca. 30 cm long and 15 cm wide electrodes (lead alloy anode, 2×SS 316 cathodes) with a hood was used to determine the effect of bubble collector guides to reduce acid mist. The cell system was able to collect all the acid mist evolved. The experiments were done with and without bubble collector guides that comprised guide members that had a linear shape and a depth of 1 cm. The hood contained an orifice on the top, from which acid mist was suctioned with a pump, collected and measured. The experiments were carried out at two temperatures: 40 and 50° C. The cathodic current density used was 300 $Am^{-2}$ and electrolysis time 6 h. The same electrolyte was circulated during the experiment. Acid mist was suctioned at 3-4.5 L/min. The sulfuric acid concentration was 186±5 g/l and the copper concentration was 37±3 g/l at the end of the experiments.

Figure 6:
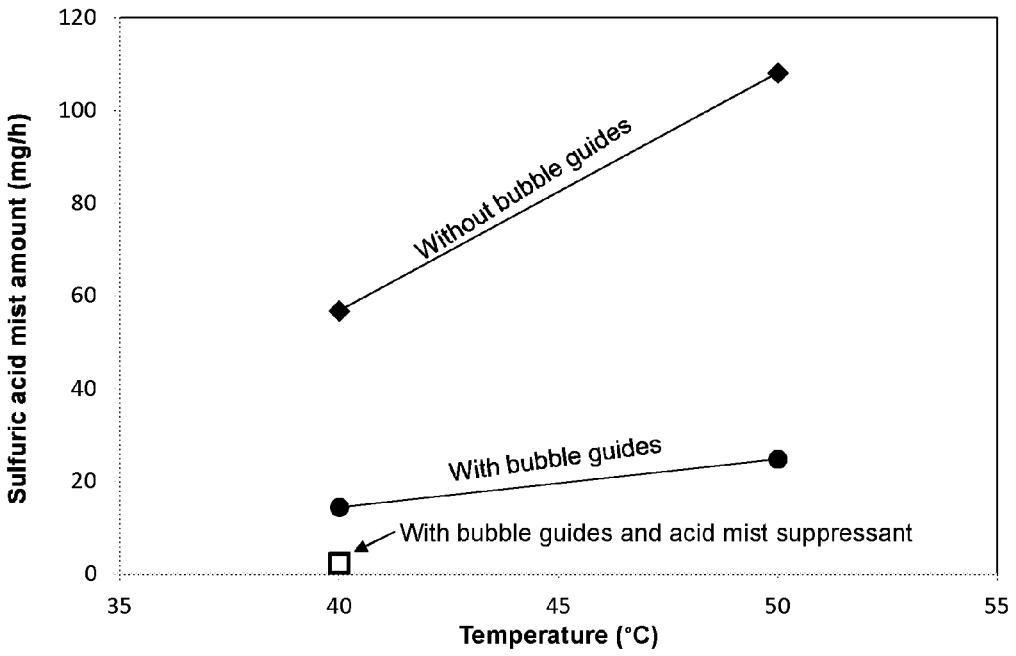
FIG. 6 shows experimental measurements of acid mist generated in a test system.

The results are shown in FIG. 6. The acid mist reduction was considerable with the bubble collector guides (bubble guides), over 75%. In a similar manner, the amount of copper in the mist was also reduced. The amount of collected acid and copper had the same ratio as the electrolyte, as expected.

Example 2

Similar experimental setup was done as in Example 1, with the exception that the electrolysis time was 4 h and only one experiment was done with the bubble collector guides at 40° C. In addition, an acid mist suppressant chemical was added into the electrolyte with the concentration of 10 ppm. The results are given in FIG. 6. The acid mist reduction together with the acid mist suppressant and the bubble collector guides was 96%.

The invention claimed is:

1. A bubble collector guide, where the bubble collector guide comprises a plurality of guide members arranged at a distance from each other horizontally along the length of a rectangular vertical surface of a plate-like electrode, the vertical surface orthogonal to opposed edge surfaces of the electrode, each of the guide members comprising a lower side and each having a proximal end and a distal end, and wherein the guide members are arranged so that the lower side of the guide member forms a downwards facing surface that is orthogonal to the vertical surface of the electrode, so as to collect bubbles of gas generated at the electrode, and wherein the bubble collector guide includes a first support member arranged along a first of the opposed edge surfaces and which connects the proximal end of a first one of said plurality of guide members with the proximal end of a second one of the plurality of guide members, and a second support member arranged along a second of the opposed edge surfaces and which connects the distal end of said first one of said plurality of guide members with the distal end of the second one of said plurality of guide members.

2. The bubble collector guide according to claim 1, where the guide member extends at least half the width of the vertical surface of the electrode.

3. The bubble collector guide according to claim 1, where the guide member is sealably attachable to the vertical surface of the electrode.

4. The bubble collector guide according to claim 1, where the guide members are arranged at an equal distance from each other.

5. The bubble collector guide according to claim 1, where the guide members are arranged at non-equal distances from each other.

6. The bubble collector guide according to claim 1, where the guide members are of the same size and depth.

7. The bubble collector guide according to claim 1, where the guide members are identical in at least one of size and depth.

8. The bubble collector guide according to claim 1, where the downwards facing surface formed by the lower side of the guide member has a linear shape.

9. The bubble collector guide according to claim 1, where the downwards facing surface formed by the lower side of the guide member has a sawedged shape.

10. The bubble collector guide according to claim 1, where the downwards facing surface formed by the lower side of the guide member has a cogged shape.

11. The bubble collector guide according to claim 1, where the guide member comprises at least one of an orifice and an aperture.

12. The bubble collector guide according to claim 1, where the support member extends farther away from the vertical side of the electrode than the guide members so as to prevent other parts of the electrolysis system from touching the guide members.

13. The bubble collector guide according to claim 1, comprising one or more spacers for keeping electrodes at a correct distance from each other.

14. The bubble collector guide according to claim 1 capable of use in an electrowinning process.

15. The bubble collector guide of claim 14 in combination with at least one of an acid mist suppressant chemical, a diaphragm bag or a hood.

16. An electrowinning process comprising:

using a bubble collector guide to reduce acid mist in the electrowinning process, the bubble collector guide comprising a plurality of guide members arranged at a distance from each other horizontally along the length of a rectangular vertical surface of a plate-like electrode, the vertical surface orthogonal to opposed edge surfaces of the electrode, each of the guide members having a proximal end and a distal end, and wherein the bubble collector guide includes a first support member arranged along a first of the opposed edge surfaces, and which connects the proximal end of a first one of said plurality of guide members with the proximal end of a second one of the plurality of guide members and a second support member arranged along a second of the opposed edge surfaces, which connects the distal end of the first one of said plurality of guide members with the distal end of the second one of the plurality of guide members; and further reducing acid mist in the electrowinning process beyond that reduced by the bubble collector guide.

17. The process of claim 16 where said step of further reducing acid mist comprises using at least one of an acid mist suppressor chemical, a diaphragm bag, and a hood.

18. A bubble collector guide comprising first and second elongate vertical support members generally parallel to each other and a plurality of spaced apart horizontal guide members arranged at a distance from each other along the respective lengths of the elongate vertical support members, the guide members comprising a lower side and each having a proximal end and a distal end, the first support member connecting the proximal end of a first one of said plurality of guide members with the proximal end of a second one of the plurality of guide members, and a second support member arranged along a second of the opposed edge surfaces and which connects the distal end of said first one of said plurality of guide members with the distal end of the second one of said plurality of guide members, the first and second elongate support members together with the first one and the second one of the plurality of guide members defining a space capable of selectively receiving a plate-like electrode having a rectangular vertical surface so that the lower side of the guide member forms a downwards facing surface orthogonal to the vertical surface of the electrode and which collects bubbles of gas generated at the electrode.

* * * * *